US005692945A

United States Patent [19]

Crowell et al.

[11] Patent Number: 5,692,945

[45] Date of Patent: Dec. 2, 1997

[54] TOY PRODUCING SIMULATED ERUPTION

[75] Inventors: Caleb E. Crowell, Montclair, N.J.; George Hom, New York; Laura Patterson, Port Washington, both of N.Y.

[73] Assignee: Educational Design, Inc., New York, N.Y.

[21] Appl. No.: 716,495

[22] Filed: Sep. 18, 1996

[51] Int. Cl.[6] ..... A63H 33/42; B01F 5/00

[52] U.S. Cl. ..... 446/183; 215/3; 215/DIG. 8; 422/236; 434/299; 446/267; 446/475

[58] Field of Search ..... 446/176, 180, 446/183, 267, 475, 483; 434/276, 298, 299; 472/52, 53, 66; 422/112, 236; 215/3, 4, 6, 900, DIG. 8

[56] References Cited

U.S. PATENT DOCUMENTS

| | | | |
|---|---|---|---|
| 1,401,185 | 12/1921 | Foster | 434/298 |
| 2,669,439 | 2/1954 | Deshayes | 422/112 X |
| 3,089,623 | 5/1963 | Padzieski | 222/205 |
| 3,453,086 | 7/1969 | Harm | 422/112 |
| 3,570,765 | 3/1971 | deGast | 239/21 |
| 4,209,113 | 6/1980 | Kuna | 222/79 |
| 5,021,219 | 6/1991 | Rudick et al. | 422/112 |
| 5,196,216 | 3/1993 | Lynch et al. | 215/DIG. 8 X |
| 5,512,003 | 4/1996 | Parker | 446/475 |

*Primary Examiner*—William H. Grieb
*Attorney, Agent, or Firm*—Carr, DeFilippo & Ferrell

[57] ABSTRACT

A toy is disclosed for producing a simulated eruption. The toy comprises a container having a first chamber for holding a predetermined quantity of a first reagent and a second chamber for holding a predetermined quantity of a second reagent. The second chamber communicates with an upstanding convergent nozzle terminating at its upper end in an orifice opening to the exterior of the container. When the sidewalls defining the first chamber are squeezed, a portion of the first reagent held therein is forced through a connecting tube into the second chamber, where the first regent reacts with the second reagent to produce gaseous products. The elevated pressure thereby created within the second chamber causes the reagent mixture to be ejected from the nozzle orifice at high velocity. The toy may additionally comprise a simulated volcano landscape having a eruption tube depending from the volcano crater which receives at its lower end the tip of the nozzle. A simulated eruption from the volcano's crater is thus produced.

6 Claims, 3 Drawing Sheets

TOY PRODUCING SIMULATED ERUPTION

FIELD OF THE INVENTION

The present invention relates to toys, and more particularly to a toy which simulates the eruption of a volcano or a similar event.

BACKGROUND OF THE INVENTION

Toys which simulate an erupting volcano are well known in the art. Such toys have great entertainment appeal to children, and may be used as an educational device to teach children about the mechanics of volcanos and related geological processes. Furthermore, the excitement generated by this type of demonstration can spark a child's interest in geological phenomena and encourage him or her to learn more about this field.

Typically, simulated volcanos employ a volcano model having at its center a chamber (representing the volcano's crater) into which is added two or more reactive substances, or reagents. When the reagents come into contact within the chamber, a volume of gas is generated thereby causing the reagent mixture to expand and flow out of the chamber and onto the slopes of the volcano model. In this manner, eruption of the volcano is simulated. Many simulated volcanos utilize baking soda (sodium bicarbonate) and vinegar (dilute acetic acid) as the reagents. These reagents react vigorously at room temperature to produce gaseous carbon dioxide. Additionally, their use is advantageous since they are commonly available in households, are non-toxic (as are the reaction products) and are generally safe for use by children.

In volcano toys of the foregoing description, the chamber in which the reaction occurs is fully open to the atmosphere, and thus pressure cannot build up within the chamber. Consequently, the reagent mixture is not ejected from the simulated crater with great force, but instead gently overflows from the crater's rim. While such a display may provide substantial visual appeal, it is postulated that a volcano simulation in which the "lava" is ejected from the crater at relatively high velocity will be considerably more entertaining to children and will more closely represent the violent nature of an eruption.

A volcano toy disclosed in U.S. Pat. No. 5,512,003 ("Simulated Volcano Toy Mold", issued to Parker) attempts to achieve a forceful simulated eruption by mechanical means. The volcano toy described therein includes a cylindrical crater or "eruption tube." A disk is placed at the bottom of the eruption tube and eruption material consisting of a multiplicity of small, discrete solid objects (such as candy, plastic pellets, etc.) is piled on top of the disk. The disk includes slots through which is threaded an elongated ribbon, the ribbon passing upwardly through the eruption tubes and the ribbon ends falling outside. To produce the simulated eruption, the user manually grasps the ribbon ends and pulls them sharply in opposite directions, causing the disk to travel rapidly up the eruption tube and throw the eruption material outwardly and upwardly from the tube.

It is believed that the approach taken by the Parker patent, while entertaining, is inherently less engaging to children than a simulated volcano driven by a chemical reaction. Furthermore, it is submitted that such an approach does not adequately simulate the flow of lava from the volcano's crater during an eruption.

SUMMARY

It is therefore an object of the present invention to provide a toy for creating a simulated eruption utilizing a chemical reaction in which the simulated lava is ejected from the crater with considerable velocity.

It is another object of the present invention to provide a toy for creating a simulated eruption which may simulate other eruptive phenomena, such as a geyser, in addition to a volcano.

It is yet another object of the invention to provide a toy for creating a simulated eruption which is safe for use by children.

The essence of the present invention lies in the use of a special dual-chambered container or bottle to produce a forceful simulated eruption. The container includes a first chamber which holds a predetermined amount of a liquid reagent, typically vinegar. The second chamber is designed to hold a predetermined amount of a second reagent, typically baking soda. The second chamber is positioned such that its lowermost point is above the uppermost point of the first chamber. A vertically oriented elongated connector tube extends between the two chambers, the tube opening at its lower end to the lower portion of the first chamber and at its upper end to the upper portion of the second chamber.

In the bottle's normal condition, the reagents are maintained separate and unmixed. When the user desires to produce the eruption effect, he or she manually squeezes the flexible walls defining the first chamber. The squeezing reduces the volume of the first chamber and forces a portion of the incompressible first reagent to flow through the connector tube and into the second chamber, where the combined reagents react to generate gaseous reaction products.

To achieve the desired forceful eruption, the second chamber is provided with an upstanding convergent nozzle which terminates at its distal end in a narrow orifice opening to the exterior. The flow restriction associated with the nozzle and orifice permits the buildup of pressure within the second chamber. This elevated pressure, together with the narrow orifice opening, causes the reagent mixture to be ejected upwardly from the nozzle at relatively high velocity.

In a preferred embodiment of the invention, the dual-chambered container is employed in connection with a model volcano landscape disposed above the bottle. The landscape includes a generally cylindrical crater opening to the upper surface thereof. A hollow eruption tube is inserted into the crater and depends downwardly therefrom. The lower end of the tube is sized to receive the distal end of the nozzle. To create the simulated volcanic eruption, the container is charged with the reagents, the tip of the nozzle is inserted into the lower end of the eruption tube depending from the volcano's crater, and the walls of the first chamber are squeezed. The reagents are thus combined within the second chamber, and the reagent mixture is upwardly ejected by the pressurized gaseous reaction products through the nozzle's orifice into the eruption tube and crater. In a typical construction and use of the invention, the reagent mixture is propelled a distance of several feet above the rim of the crater, thereby representing an eruption of great force which is highly attractive to children.

In addition to the volcano, other eruptive phenomena may be simulated by the present invention, such as a geyser. The container may also be used in a more fanciful manner to create a "fountain" or the like.

DETAILED DESCRIPTION OF THE INVENTION

Figure 2:
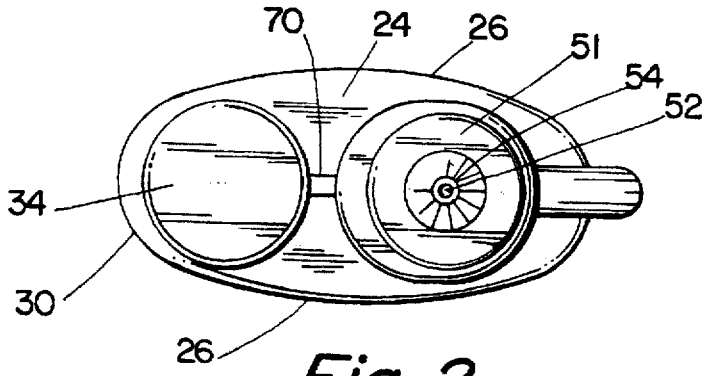
FIG. 2 depicts a top plan view of the dual-chambered container.
Figure 1:
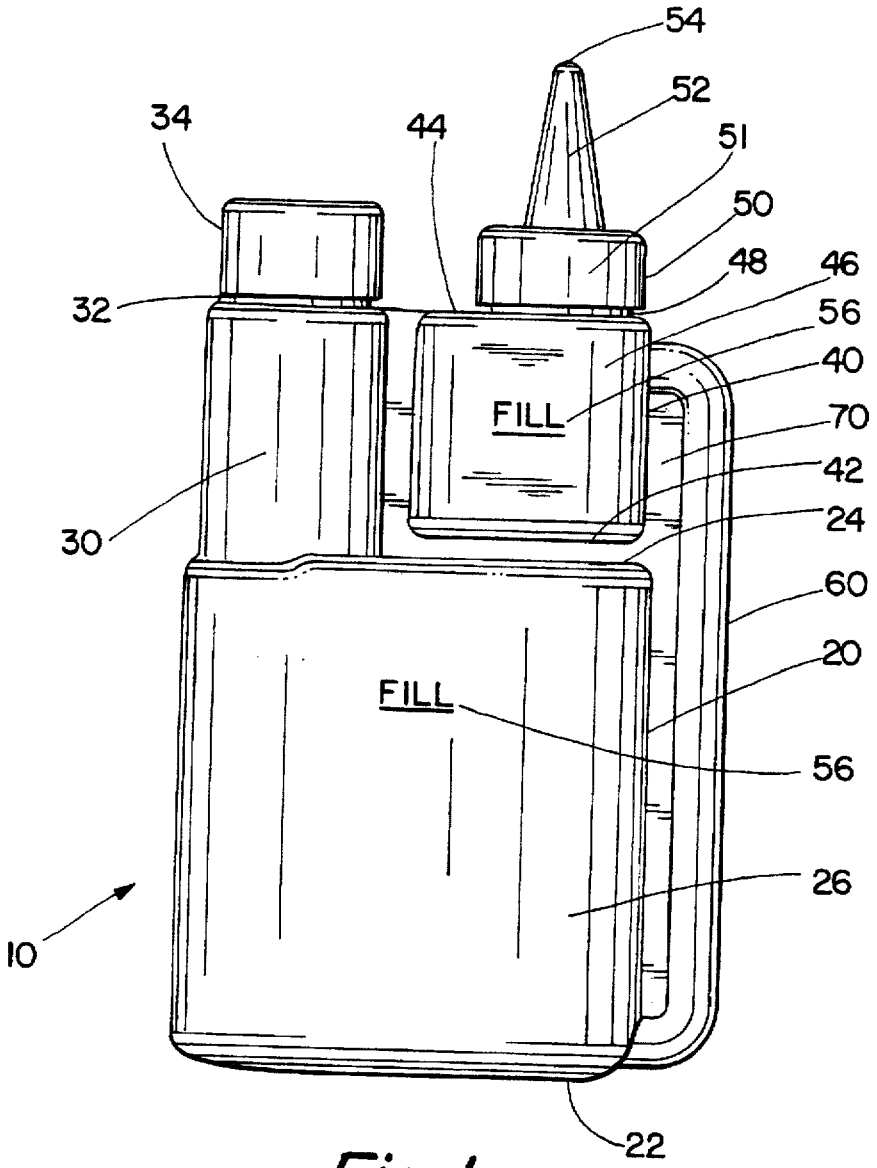
FIG. 1 depicts an elevational from view of a dual-chambered container according to the present invention.
Figure 3:
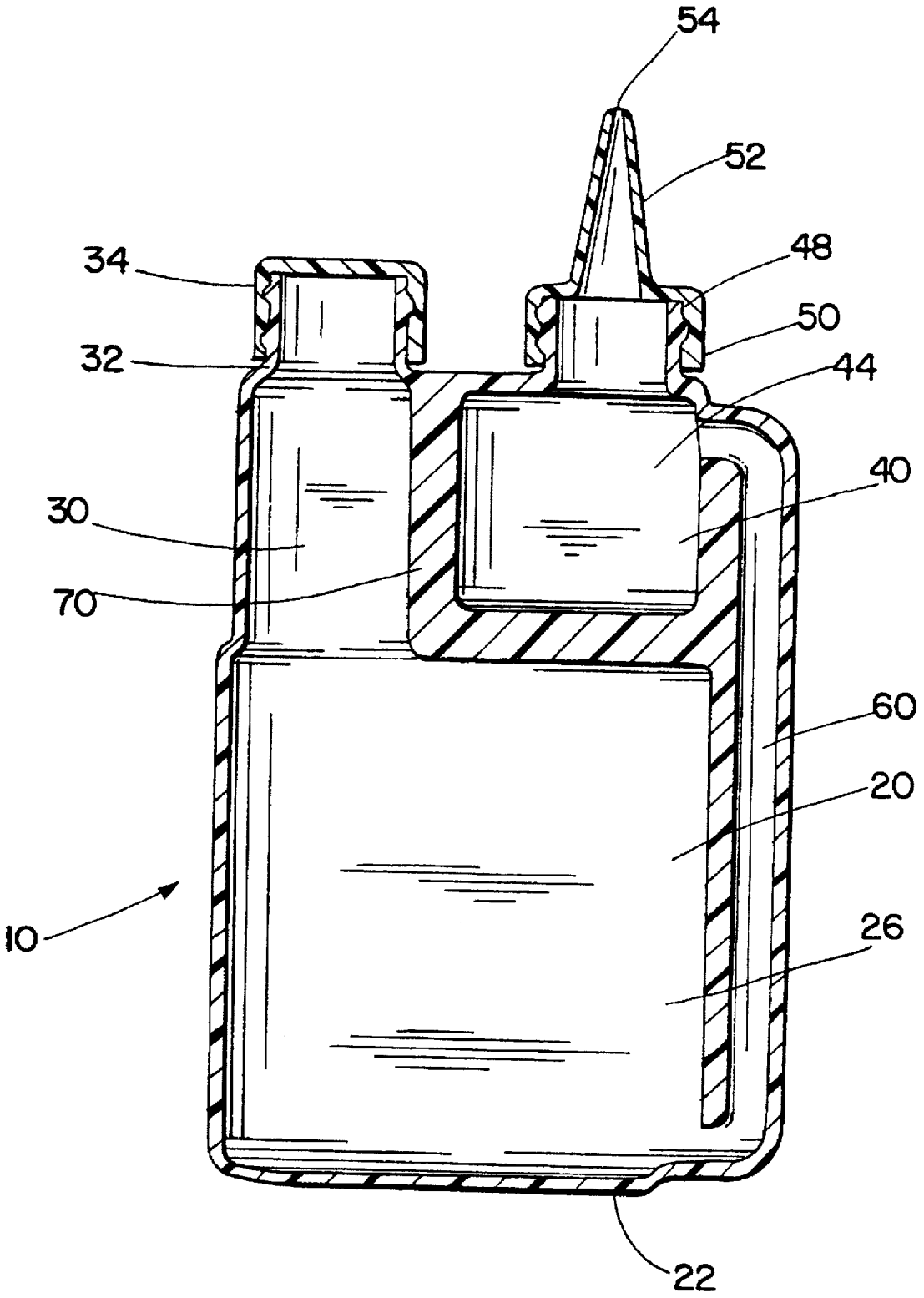
FIG. 3 depicts a cross-sectional view of the dual-chambered bottle taken along the vertical plane of symmetry of the container.

The present invention makes use of a dual-chambered container of the type historically utilized to dispense a predetermined quantity of a liquid substance. For a description of a similar dual-chambered container and its use for this purpose, reference may be made to U.S. Pat. No. 3,089,623 ("Device for Dispensing Predetermined Quantities of Liquid", issued to Padzieski).

As depicted in the figures, it is seen that there is provided according to the present invention a container (generally referred to as 10) having two distinct chambers each intended to hold a quantity of a reagent. While the material of the container is not essential to the invention, it is contemplated that the container will be fabricated from a strong, flexible polymeric substance such as high density polyethylene. As is discussed below, it is critical to the operation of the invention that the sidewalls of the first chamber be sufficiently flexible to permit manual compression thereof. It is also advantageous to construct the container from a transparent or translucent material to enable the user to visually monitor the level of the reagents within the chambers. The container may be formed by injection molding or any other suitable manufacturing technique.

First chamber 20 is defined by floor 22, roof 24 and sidewall 26. The interior volume of the first chamber is sized to hold a quantity of the first reagent sufficient to produce the desired reaction. Typically, the capacity of the first chamber will be approximately four (4) fluid ounces. To enable addition of the first reagent to the first chamber, container 10 is provided with vertically oriented filler tube 30 opening at its lower end to the top of the first chamber and extending upwardly therefrom. The filler tube terminates at its upper end in neck 32 having threads formed externally thereon for engagement with internally threaded cap 34. The cap may be unscrewed from the neck to permit the user to add reagent to first chamber through the filler tube. When the cap is replaced and screwed down tightly on the neck, a seal is achieved closing the first chamber to the exterior.

Second chamber 40 is defined by floor 42, roof 44 and sidewall 46. The second chamber has an interior volume sized to receive a predetermined quantity of the second reagent, which is typically a solid powder. It is appreciated that the second chamber floor is disposed above the roof 24 of first chamber 20 when container 10 is placed in an upright position. The second chamber roof is adapted with externally threaded neck 48 for engagement with nozzle cap 50. The nozzle cap comprises a lower flange having internal threads for engaging neck 48 and an upstanding convergent nozzle 52 having its lower, wider end opening to and in communication with the second chamber. The upper, narrower end of the convergent nozzle terminates in orifice 54 opening to the exterior of container 10. Addition of the second reagent to the second chamber is accomplished by first unscrewing nozzle cap 50 from neck 48, which permits access to the chamber. Following addition of the reagent, the nozzle cap is replaced and screwed tightly to the neck.

First and second chamber sidewalls 26 and 46 may be provided with indicia 56, typically consisting of horizontal line segments, indicating to the user the preferred or maximum quantities of reagents to be added to the chambers. The indicia may be printed on the sidewalls or formed as raised lines thereon.

Elongated connector tube 60 is spaced laterally from the sidewalls of first chamber 20 and second chamber 40 and extends vertically between the lowermost portion of the first chamber and the uppermost portion of the second chamber. The connector tube opens at its lower end to the interior of first chamber 20 proximal to floor 22 and at its upper end to the interior of the second chamber proximal to second chamber roof 44. The relative spacing of the first and second chamber and connector tube permits the reagents to remain separate and unmixed when the container is upright and in a normal, uncompressed condition. When the first chamber sidewalls 26 are squeezed by the user, the volume of the first chamber is decreased, thereby forcing a portion of incompressible liquid reagent through the connecting tube and into the second chamber. As is discussed in further detail below, the eruption effect is accomplished by reaction of the reagents within the second chamber.

Container 10 is further provided with solid, substantially flat partition member 70 which holds the first and second chamber, filler tube and connector tube in proper spaced relationship and maintains the structural integrity of the container.

Figure 4:
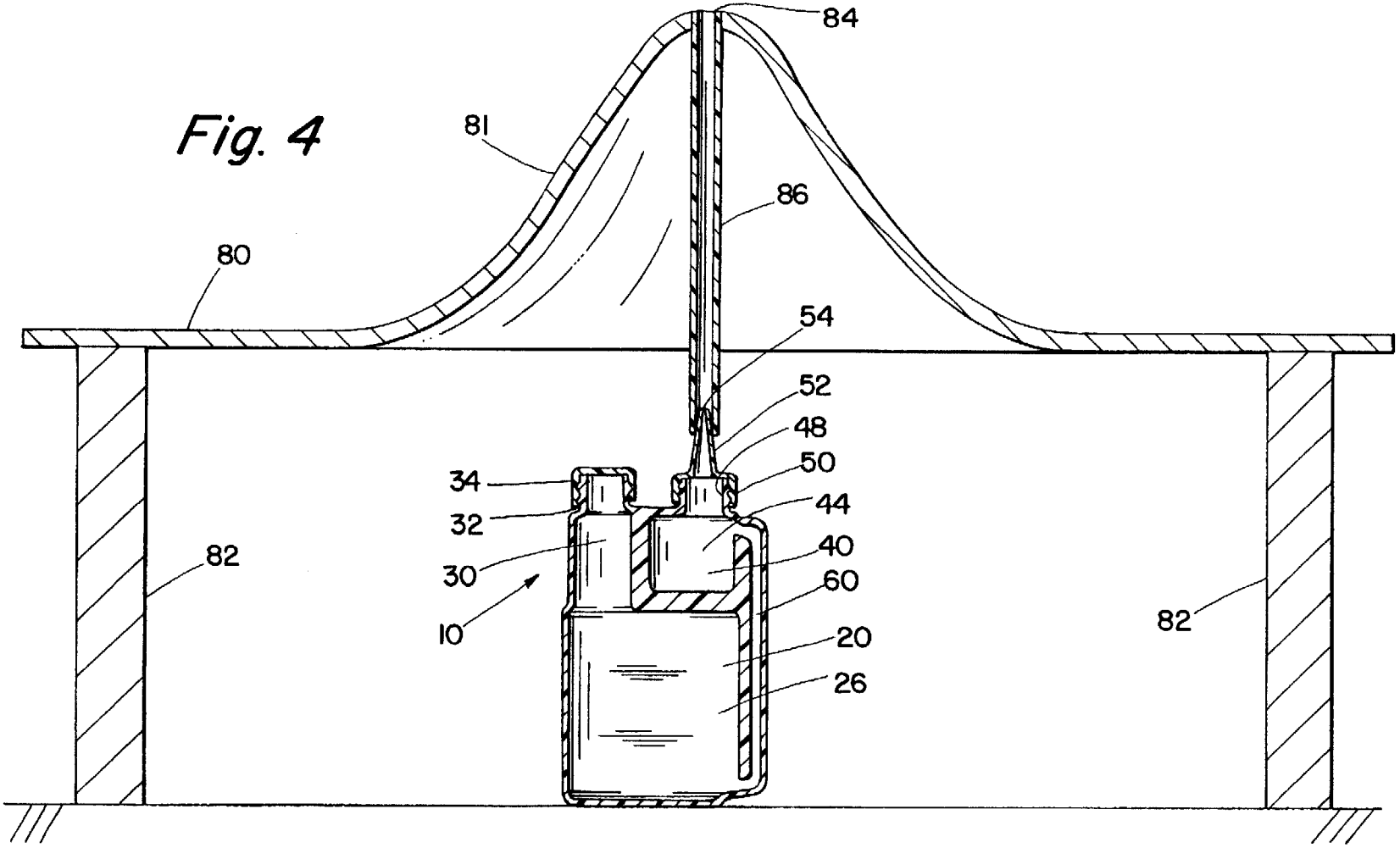
FIG. 4 depicts a cross-sectional view of the dual-chambered container as used in connection with the volcano landscape in a preferred embodiment of the invention.

In a preferred embodiment of the invention, container 10 is used in conjunction with model volcano landscape 80, as is depicted in FIG. 4. The construction of the landscape is not of essence to the present invention, but will typically comprise a generally horizontally oriented shell having contouring 81 representative of a volcano. The upper surface of the landscape may be painted or otherwise decorated to further simulate the appearance of a volcano. The landscape is preferably provided with a plurality of downwardly depending legs 82 arranged to support the landscape on a flat surface such as a table or floor, with the landscape vertically spaced from the supporting surface.

Crater opening 84 is disposed centrally to the simulated volcano portion of the landscape and opens at its upper end to the upper surface thereof. Depending downwardly from the crater opening is eruption tube 86. The lower end of the eruption tube receives the upper end of convergent nozzle 52. The eruption tube length is selected such that container 10 may be held upright on the supporting surface with the upper portion of the nozzle within the eruption tube.

Operation of the Preferred Embodiment

The preferred reagents for utilization in the present invention are vinegar (dilute acetic acid) as the first reagent and baking soda (sodium bicarbonate) as the second reagent. As mentioned hereinabove, these reagents are believed to be advantageous because of their high reactivity at room temperature, along with their common household availability and non-toxic character. It is noted that other dilute acidic liquids, such as lemon juice, may be used as the first reagent, and other carbonates, such as washing soda (sodium carbonate) and baking powder, may substitute for the baking soda. However, these substitutions may change the force of the resultant simulated eruption, and some of the alternative reagents may be of a noxious, irritating or toxic nature, rendering them less suitable for use by children.

To prepare container 10 for the simulated eruption, nozzle cap 50 and filler tube cap 34 are removed from the container by unscrewing them from, respectively, second chamber neck 48 and filler tube neck 32. The container is then placed in an upright position and the first reagent is added through filler tube 30 to first chamber 20. A funnel having its bottom stem inserted into the filler tube may be employed to facilitate pouring the reagent into the tube. The second reagent is then added to the second chamber 40. The quantities of reagents may either be pre-measured prior to their addition to their respective chambers, or alternatively indicia 56 may be employed to guide the user as to the proper quantities to add.

The filler tube cap and nozzle caps are then replaced to the corresponding necks and screwed down tightly. The container is placed underneath the simulated landscape with the upper end of nozzle 52 received within the lower portion of eruption tube 86. As discussed above, the length of the eruption tube is adjusted to permit the container to be held upright on the supporting surface, as shown in FIG. 4. To achieve the simulated eruption effect, the user manually squeezes first chamber sidewalls 26. This action reduces the interior volume of the first chamber and forces a portion of the vinegar through connector tube 60 and into second chamber, where it contacts the baking soda held within.

The mixed vinegar and baking soda react vigorously within the second chamber to produce gaseous carbon dioxide. As a result of the flow restriction posed by convergent nozzle 52 and orifice 54, a substantial amount of pressure builds up within the chamber, which in turn causes the reagent slurry, or simulated lava, to be ejected from the orifice at high velocity. The simulated lava travels through the eruption tube and emerges from the simulated volcano crater with great force, thereby representing a violent eruption.

It is to be noted that the present invention contemplates alternative constructions of the dual-chambered container, specifically with respect to the arrangement and spacing of the chambers and connector tube. For example, the container may be formed with the first and second chambers in side-by-side relation with the connector tube describing an inverted U-shape, the apex of the tube being positioned above the upper portion of the chambers. Many other container geometries within the scope of the present invention will be apparent to one having ordinary skill in the art.

It is further noted that the volcano embodiment of the invention is intended to be merely illustrative. The dual-chambered container of the foregoing description may be utilized in connection with landscapes simulating other eruptive features, such as a geyser. Other, more fanciful uses of the container, such as its use to create a "fountain" are also anticipated by the invention.

It should be understood that an unlimited number of configurations of the present invention can be realized which satisfy the requirements described above. The foregoing discussion discloses and describes merely exemplary embodiments of the present invention. One skilled in the art will readily recognize from the discussion, and from the accompanying drawings and claims, that various changes and modifications can be made without departing from the spirit and scope of the invention, as defined in the following claims.

What is claimed is:

1. A toy for creating a simulated eruption comprising:

a dual-chambered container comprising:

a first chamber for holding a predetermined quantity of a first reagent, said first chamber including means for adding said first reagent thereto and further including a removable closure for closing said first chamber to the atmosphere, said first chamber having walls of flexible construction;

a second chamber for holding a predetermined quantity of a second reagent, said second chamber having its lowermost portion disposed above the uppermost portion of said first chamber;

an upstanding nozzle removably secured to and communicating with said second chamber and terminating at its upper end in an orifice opening to the exterior of said container;

an elongated connector tube extending between said first chamber and said second chamber, said connector tube opening at its bottom end to the lower portion of said first chamber and at its upper end to the upper portion of said send chamber, said connector tube permitting the flow therethrough of said first reagent from said first chamber to said second chamber when said walls of said first chamber are compressed, and;

a simulated landscape disposed above said container, said landscape including at least one downwardly directed hollow channel opening at its upper end to the upper surface of said simulate landscape, said channel interiorly receiving at its lower end the upper portion of said nozzle.

2. A toy for creating a simulated eruption according to claim 1, wherein said means for adding said first reagent to said first chamber comprises a hollow filler tube having its lower end opening to said first chamber and said closure comprises a filler tube cap removably secured to the upper end of said filler tube.

3. A toy for creating a simulated eruption according to claim 1 wherein said landscape is formed in the shape of a volcano.

4. A method for creating a simulated eruption comprising the steps of:

(a) providing a dual-chambered container having a first chamber for holding a first reagent and a second chamber for holding a second reagent, said first chamber being disposed with the uppermost portion thereof below the lowermost portion of said second chamber when said container is held in an upright position, said second chamber communicating with an upstanding nozzle terminating at its upper end in an orifice opening to the exterior, said container further comprising a connector tube extending between said first chamber and said second chamber, said connector tube having a lower end opening to the lower portion of said first chamber and an upper end opening to the upper portion of said second chamber;

(b) holding said container in an upright position;

(c) adding a predetermined quantity of said first reagent to said first chamber;

(d) adding a predetermined quantity of said second reagent to said second chamber, said second reagent being reactive with said first reagent to produce gaseous products, and;

(e) squeezing the walls of said first chamber such that a portion of said first reagent is forced from said first chamber to said second chamber through said connector tube.

5. A method for creating a simulated eruption according to claim 4 wherein said first reagent is vinegar and said second reagent is baking soda.

6. A container for producing a simulated eruption comprising:

a first chamber for holding a predetermined quantity of a first reagent, said first chamber including filler means for adding said first reagent thereto, said filler means including a removable closure for closing said first chamber to the atmosphere, said first chamber having walls of flexible construction;

a second chamber for holding a predetermined quantity of a second reagent, said second chamber being positioned relative to said first chamber so as to maintain said first reagent and said second reagent separate and unmixed when said container is placed in an upright position;

an upstanding nozzle removably secured to and communicating with said second chamber and terminating at its upper end in an orifice opening to the exterior of said container, and;

an elongated connector tube extending between said first chamber and said second chamber, said connector tube opening at its first end to said first chamber and at its second end to said second chamber, said connector tube permitting the flow therethrough of said first reagent from said first chamber to said second chamber when said walls of said first chamber are compressed.

* * * * *